United States Patent [19]

Feldmann et al.

[11] Patent Number: 4,803,863

[45] Date of Patent: Feb. 14, 1989

[54] APPARATUS FOR ROLLING BAR STOCK

[75] Inventors: Hugo Feldmann, Alsdorf-Warden; Hubert Müller, Grevenbroich; Claus Schlanzke, Ratingen, all of Fed. Rep. of Germany

[73] Assignee: SMS Schloemann-Siemag AG, Dusseldorf, Fed. Rep. of Germany

[21] Appl. No.: 111,381

[22] Filed: Oct. 20, 1987

[30] Foreign Application Priority Data

Oct. 20, 1986 [DE] Fed. Rep. of Germany ..... 3635566

[51] Int. Cl.[4] ..... B21B 27/02; B21B 1/16; B21B 13/10

[52] U.S. Cl. ..... 72/199; 72/366

[58] Field of Search ..... 29/110, 121.1, 121.5, 29/125, 130; 72/199, 221, 224, 366

[56] References Cited

U.S. PATENT DOCUMENTS 4,674,312 6/1987 Cook ..... 29/130 X

FOREIGN PATENT DOCUMENTS 741884 5/1953 Fed. Rep. of Germany .
2035482 1/1972 Fed. Rep. of Germany .
3433300 3/1986 Fed. Rep. of Germany .
882671 11/1981 U.S.S.R. ..... 72/224
1071336 2/1984 U.S.S.R. ..... 72/199

*Primary Examiner*—E. Michael Combs
*Attorney, Agent, or Firm*—Herbert Dubno

[57] ABSTRACT

A pair of roll grooves defining a rolling passage for the bar stock in respective rolls having abutting or bearing portions which are undercut to increase elasticity and are separated from the grooves by recesses. The force with which the rolls are pressed against one another far exceeds the rolling force.

5 Claims, 1 Drawing Sheet

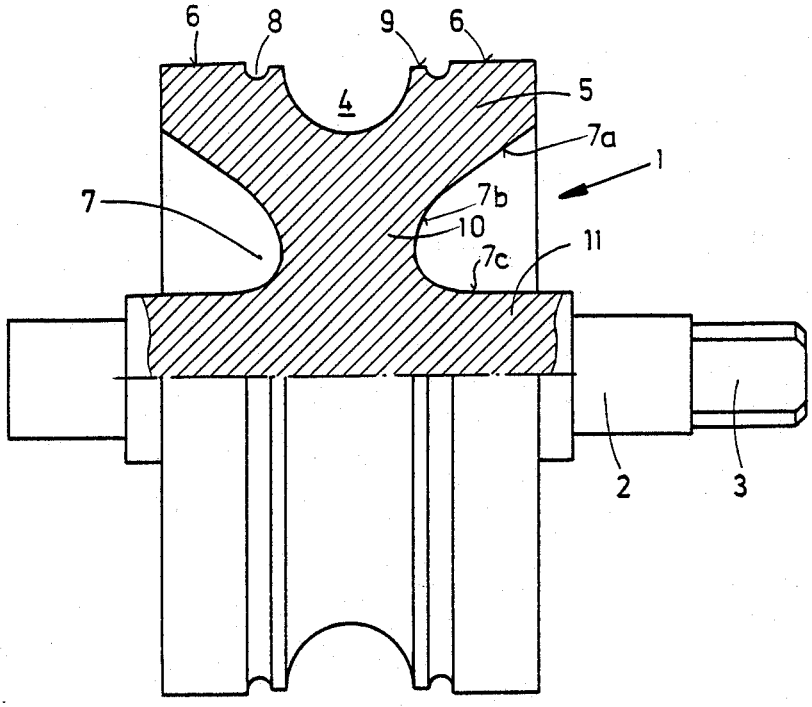
6
8
9
6
4
5
7a
1
7
7b
10
11
7c
2
3

APPARATUS FOR ROLLING BAR STOCK

FIELD OF THE INVENTION

Our present invention relates to an apparatus for the rolling of bar stock, also referred to herein as profiled rolled stock, to products having low dimensional tolerances. More particularly, this invention relates to the production by rolling of structural shapes such as rounds but also other shapes defined by a closed rolling periphery and therefore referred to generically as profiled stock, from elongated workpieces which may have been previously rolled or otherwise shaped to the general form of the product desired so that the rolling mill of the invention can constitute a finishing mill or, more generally, the dimensioning and final-shape-imparting roll mill.

BACKGROUND OF THE INVENTION

Bar stock such as round rods and other shapes can be made by rolling an elongated workpiece between rolls having at least one caliber or channel formed in the circumference of the roll.

A shape-determining groove or channel is one which, with a registering channel of another roll will define a passage between the rolls through which the workpiece can pass and which together form the closed periphery of the passage which has both the cross section and dimensions of the bar stock to be made.

It is known to provide a pair of such rolls with registering grooves defining a closed passage and to place the rolls together so that they are urged against one another with a prestressing force which, at least in part, controls the dimensions of the passage.

From German Patent DE-PS No. 741,884, it is known that a bending of the shaping rolls during the rolling of strip can be reduced by the use of so-called caliber rolls, i.e. rolls which have grooves defining the caliber of the product made, i.e. the passage through which the workpiece passes. In this system, a passage is formed which has the width of the strip to be rolled and adjacent this passage and hence the grooves defining same, the juxtaposed rolls are formed with end regions which bear against one another with a prestressing force exceeding the rolling force.

While this technique does reduce the bending of the rolls to a certain extent it has been found to be insufficient to completely eliminate such bending.

In German Patent Document - Open Application DE-OS No. 34 33 300, the rolling of bar stock between rolls which define the caliber or passage is described as being associated with the application of a prestressing force of the rolls against one another adjacent the caliber grooves with a prestress that significantly exceeds the rolling force.

The purpose of this prestress is to maintain the dimensions of the rolled product by preventing the expansion of the roll set defining the caliber. In this case, any change in the rolling force is effectively counteracted by the prestress.

It is possible with that system as well by controlling the applied or pressing force of the rolls against one another and thereby varying the prestressing force to vary the degree of elastic flattening of the mutually abutting surfaces of the rolls and thereby change the dimensions of the passage and, as a consequence the dimension of the rolled product. In this case, the change in the prestressing force can be used as an adjustment or setting for direct control of the dimensions of the product.

A disadvantage with such setting and control operations is that the flattening of the rolls requires such high forces that the prestressing force may have to be so much higher than the rolling force that the results are detrimental to effective operation of the system. For example, since the mill frame must withstand the high pressing forces which are applied, the mill must be dimensioned far more massively.

OBJECTS OF THE INVENTION

It is the principal object of the present invention, therefore, to provide an improved apparatus for the rolling of bar stock which permits a satisfactory level of prestressing force to be applied as to generate a reasonably large range of adjustability in the dimensioning of the product and, in addition, a satisfactory level of deformability of the rolls under this prestressing force so that the rolling processes can be independent largely from any expansion or yielding of the frame and can allow the latter to have a steep spring characteristic line while at the same time simplifying control of the dimensions without the drawbacks mentioned previously.

Another object of this invention is to provide an apparatus for the rolling of bar stock which can enable the product to be made with very low tolerances.

SUMMARY OF THE INVENTION

These objects and others which will become apparent hereinafter are attained, in accordance with the present invention by a method for the low-tolerance rolling of bar stock with a plurality of rolls having one or more caliber or shaping defining grooves flanked by mutually abutting portions of the roll surface. According to the invention, the rolls are pressed together with a pressing force ($F_a$) which is substantially in excess of the rolling force ($F_w$) required to roll the bar stock and is sufficient to cause the rolls in addition to abut with a prestressing force ($F_v$). To change the dimensions of the passage defined by the registering grooves, we can vary the prestressing force ($F_v$) and thus the deformation of the mutually abutting portions of the rolls.

According to the invention, these mutually abutting portions of the rolls are undercut to increase the elastic deformability of these regions under the effect of the prestressing force ($F_v$) and between these regions and the caliber groove or channel, grooves are formed which separate the undercut or more deflectable portion from the rigid portion part of the roll which is formed with the channel.

According to the feature of the invention a roll for carrying out this method has cylindrical abutting portions adjacent a boundary surface which extends to the respective groove. The diameters of the boundary portions are slightly less than the diameters of the abutting cylindrical or, conversely, the diameters of the abutting cylindrical portions slightly exceed the diameter of the boundary portions. Between the boundary portions and the abutting cylindrical portions, the aforementioned recesses which may also be grooves, are advantageously provided. Best results are obtained when these recesses have semicircular cross sections.

The undercuts make the cylindrical portions of the rolls elastically deform to an extent which can not be achieved with roll structures and thus enable the deformation of the two rolls against one another to a much greater extent by roll flattening for a given change in the prestressing force. The range of adjustability of the passage dimensions is thereby markedly increased.

Furthermore, the high degree of flexibility of the rolls permits expansion and contraction of the frame and of the roll set to be compensated without change in the rolling conditions to any significant extent.

Furthermore, because the prestressing force can be relatively reduced, massive reinforcement of the mill stand is not necessary and the adjustment of the prestressing force can use simple and lightweight control devices.

Frame expansion and increased rolling force because of a change in the characteristics of the workpiece can readily be taken up by elastic deformation of the rolls.

BRIEF DESCRIPTION OF THE DRAWING

The above objects, features and advantages of our invention will become more readily apparent from the following description, reference being made to the accompanying drawing in which the sole FIG. is an elevational view of a roll for use in the method of the present invention, partly in cross section.

SPECIFIC DESCRIPTION

In the drawing, we have shown a roll which can be mounted in a rolling mill stand of any convention type, capable of exerting a force of one roll against the other so as to generate the rolling force as well as the bearing or prestressing force as will be described in greater detail below. The roll may be substituted for the upper and lower rolls of the roll stand described in our commonly owned concurrently filed copending application Ser. No. 07/111,388 based upon the same German priority application as the present case. In this roll stand, the two vertical-axis rolls of this copending application can be eliminated.

The Figure is a half section through one of the working rolls which has a pair of stubs 2 on which the roll body is journalled. One of these stubs can be formed with an extension 3 which allows the roll to be coupled to the drive spindle as described in this copending application.

Midway along the axial length of the usual periphery or rim of the roll body in radial alignment with a rigid portion or web 10 of the roll 1 connecting the hub 11 thereof to the periphery, there is provided a caliber or shaping groove or channel 4 which makes up practically half the caliber or passage through which a workpiece can be fed. This roll bears against an identical roll positioned thereabove so that the grooves or channels of the two rolls define the passage.

Laterally of the groove 4, the peripheral portions are undercut by recesses 7 to form wings which decrease in thickness axially outwardly, the undercuts 7 increasing the radial elasticity of the regions 5 which are formed with cylindrical abutting surfaces 6 flanking the groove 4. The recesses 7 are formed with portions 7*a*, 7*b* and 7*c* defining the peripheral surfaces of the recesses. The two juxtaposed rolls are pressed toward one another with an applied force ($F_a$) which is substantially greater than the rolling force ($F_w$) applied by the rolls to the workpiece by an amount of the prestressing force ($F_v$) with which the surfaces 6 bear upon one another.

The wings 5 and their abutment surfaces 6 can thus be deformed substantially to allow the rolling passage dimensions to be changed.

Immediately outwardly of the grooves 4, setback transition surfaces 9 or boundary surfaces are provided whose diameters are less than the diameters of the portions 6. The surfaces 9 close the caliber or passage. The setback of the surfaces 9 ensures that the wings 5 will be deformed when the rolls are pressed together.

The deformable portions 5, 6 are decoupled from the groove 4 by further grooves or recesses 8 which advantageously are of semicircular cross section and are significantly less deep than the groove 4. In operation, the two rolls of the type described can be mounted in a mill of the type described in German Patent Document DE-OS No. 34 33 300 and pressed together with a force $F_a$ so that rolls bear upon each other with a force $F_v$ and deform the respective portions 5. The force $F_a$ is substantially greater than the rolling force $F_w$ with which the workpiece is deformed.

The difference between these forces is sufficient to insure that there will be no spread of the rolls as a result of the increased rolling forces or relaxation or expansion of the frame. Any such developments can be absorbed within the elasticity of the abutting regions of the rolls. The range of adjustment afforded by the improvement elasticity of the rolls is also considerable and because of the increased elasticity of the rolls massive dimensions made not be provided for the frame to accommodate the high forces which otherwise would be necessary for roll deformation.

We claim:

1. An apparatus for rolling bar stock, comprising:

a mill frame; and two rolls mounted in said frame, said rolls defining a closed-periphery passage of a workpiece to be rolled, each of said rolls being rotatable about an axis of rotation and comprising:

a rim comprising a peripheral surface bearing on the other roll and provided with a groove coaxial with said axis and delimiting said passage, two deformable wings flanking said groove, each of said wings having setback transition portions adjacent said groove, said setback portions having respective cylindrical peripheral surfaces, deformable portions extending outwardly beyond said transition setback portions, each of said deformable portions being of a substantially larger axial width than said setback portions, a respective recess decoupling each respective deformable portion from the respective setback portion, said recesses having depths less than that of said groove, and a web extending inwardly from the respective rim, said web being formed with annular axially inwardly extending undercuts inwardly of the respective wings, and means for pressing said rolls against each other with an applied force (Fa) exceeding a rolling force (Fv) applied to the workpiece to be rolled by a prestressing force (Fw) acting on said deformable portions of said wings, so that a dimension of said passage is varied by regulating said prestressing force.

2. The apparatus defined in claim 1 wherein said recesses have semicircular cross sections.

3. The apparatus defined in claim 1 wherein each of said undercuts having a peripheral surface provided with:

a frustoconical portion terminating short of the respective deformable portion, a cylindrical portion terminating at a distance from said axis of rotation, and a curve bridging said frustoconical and said cylindrical portions.

4. A roll for rolling bar stock to low dimensional products which comprises a roll body having a circumferential groove formed in its periphery and abutting surfaces on portions of said roll body flanking the groove, said roll body being provided with undercuts inwardly of each surface to increase the elasticity of respective abutting portions of the roll, said periphery being formed with respective recesses between each of said portions and the respective groove for decoupling each of said portions from the groove whereby two such rolls can be urged together with an applied force ($F_a$) greater than a rolling force ($F_v$) for bar stock in a passage defined by grooves of said rolls to create a prestressing force ($F_v$) with which corresponding portions of said rolls abut and are deformed wherein said periphery has boundary surfaces adjacent said groove which are of a smaller diameter than that of said abutting surfaces, and wherein the roll further comprises a respective recess formed in said periphery between each of said boundary surfaces and the respective abutting surface.

5. The roll defined in claim 4 wherein said recesses have semicircular cross sections.

* * * * *